US009265368B2

(12) United States Patent
Blethen et al.

(10) Patent No.: US 9,265,368 B2
(45) Date of Patent: Feb. 23, 2016

(54) BEDDING APPARATUS

(71) Applicant: Zzz Sock, LLC, Mount Prospect, IL (US)

(72) Inventors: Jeffrey Ronald Blethen, Mount Prospect, IL (US); Kyle Parker Blatt, Mount Prospect, IL (US)

(73) Assignee: Zzz Sock, LLC, Mount Prospect, IL (US)

( * ) Notice: Subject to any disclaimer, the term of this patent is extended or adjusted under 35 U.S.C. 154(b) by 0 days.

(21) Appl. No.: 14/289,238

(22) Filed: May 28, 2014

(65) Prior Publication Data

US 2014/0352064 A1 Dec. 4, 2014

Related U.S. Application Data

(60) Provisional application No. 61/829,733, filed on May 31, 2013.

(51) Int. Cl.
*A47G 9/02* (2006.01)

(52) U.S. Cl.
CPC ..... *A47G 9/0238* (2013.01); *A47G 9/0246* (2013.01); *A47G 9/02* (2013.01)

(58) Field of Classification Search
CPC ..... A47G 9/00–9/086
See application file for complete search history.

(56) References Cited

U.S. PATENT DOCUMENTS

| | | | |
|---|---|---|---|
| 65,262 | A | 5/1867 | Ouroussoff |
| 2,324,665 | A | 7/1943 | Ayres |
| 2,368,220 | A | 1/1945 | Hinds |
| 2,972,757 | A | 2/1961 | Adrian |
| 3,120,721 | A | 2/1964 | Bukatman et al. |
| 3,241,161 | A | 3/1966 | Dashosh et al. |
| 4,236,263 | A | 12/1980 | Allee |
| 4,241,466 | A | 12/1980 | Mendyk |
| 4,292,700 | A | 10/1981 | Markel |
| 4,304,018 | A | 12/1981 | McClam |
| 4,413,368 | A | 11/1983 | Schuetze |
| 4,459,714 | A | 7/1984 | Lin |
| 4,513,461 | A | 4/1985 | Tardivel |
| 4,601,076 | A | 7/1986 | Knobeloch |

(Continued)

OTHER PUBLICATIONS

Therm-a-Rest Ventra Down Comforter Sleeping Pad Accessory; available at www.backcountryedge.com; printed prior to May 31, 2013. (1 page).

(Continued)

*Primary Examiner* — Peter M Cuomo
*Assistant Examiner* — Brittany Wilson
(74) *Attorney, Agent, or Firm* — Neal, Gerber & Eisenberg LLP

(57) ABSTRACT

Various embodiments of the present disclosure provide a bedding apparatus. In one embodiment, the bedding apparatus is configured to slip over a mattress such that the bedding apparatus substantially encloses the mattress except the front or head of the mattress. The bedding apparatus is configured such that, once installed over the mattress, there is sufficient space between the top of the mattress and the top panel of the bedding apparatus to enable a user to lay atop the mattress and under the top panel of the bedding apparatus. Additionally, once installed, the bottom panel of the bedding apparatus is positioned under the mattress such that the bedding apparatus is held in place by a combination of the weight of the mattress and the weight of the user (when the user is laying on the mattress).

18 Claims, 9 Drawing Sheets

(56) References Cited

U.S. PATENT DOCUMENTS

| | | | |
|---|---|---|---|
| 4,709,307 | A | 11/1987 | Branom |
| 4,758,868 | A | 7/1988 | Frijlink |
| 4,759,090 | A | 7/1988 | Sachetti |
| 4,774,734 | A | 10/1988 | Mills |
| 4,839,777 | A | 6/1989 | Janko et al. |
| 4,841,587 | A | 6/1989 | Carter et al. |
| 4,875,245 | A | 10/1989 | Isola |
| 4,878,258 | A | 11/1989 | Casey |
| 4,972,533 | A | 11/1990 | Brown |
| 5,003,655 | A | 4/1991 | Kafai |
| 5,066,001 | A | 11/1991 | Wilkinson |
| 5,208,927 | A | 5/1993 | Lachmar |
| 5,244,278 | A | 9/1993 | Robitaille |
| 5,465,440 | A | 11/1995 | Heptner |
| 5,566,411 | A | 10/1996 | Eiler |
| 5,740,566 | A | 4/1998 | Stacy |
| 6,098,219 | A | 8/2000 | Milber |
| 6,243,895 | B1 | 6/2001 | Amin |
| 6,490,741 | B1 | 12/2002 | Wheeler |
| 6,651,278 | B2 | 11/2003 | Ghanem |
| 6,886,197 | B1 | 5/2005 | Madigan |
| 7,051,387 | B1 | 5/2006 | Yoder et al. |
| D593,788 | S | 6/2009 | Thompson |
| 7,806,080 | B2 | 10/2010 | Morse |
| 7,818,833 | B2 | 10/2010 | Ewing |
| 7,845,031 | B2 | 12/2010 | Tatsuno |
| 8,214,949 | B2 | 7/2012 | Thompson |
| 8,640,282 | B2 | 2/2014 | Maguire et al. |
| 8,756,730 | B2 | 6/2014 | MacDonald |
| 2003/0177579 | A1 | 9/2003 | Diak/Ghanem |
| 2006/0053553 | A1 | 3/2006 | Gomeh |
| 2006/0248646 | A1 | 11/2006 | Marsh |
| 2008/0216238 | A1 | 9/2008 | Tatsuno |
| 2009/0044337 | A1 | 2/2009 | McKee |
| 2009/0293195 | A1 | 12/2009 | McGrath et al. |
| 2010/0251482 | A1 | 10/2010 | MacDonald |
| 2012/0204348 | A1 | 8/2012 | Bayer |

OTHER PUBLICATIONS

Disney Princesses EZ Bed; available at http://www.walmart.com/ip/Disney-Princesses-EZ-Bed/8812037; printed prior to May 31, 2013. (1 page).

Disney Cars EZ Bed; available at http://www.walmart.com/ip/Disney-Cars-EZ-Bed/8812034; printed prior to May 31, 2013 . (1 page).

Sleeping Bag Sofa; available at http://www.dudeiwantthat.com/household/furniture/sleeping-bag-sofa.asp; printed prior to May 31, 2013. (2 pages).

Zipit Bedding, website, zipitbedding.com/Home.html, screenshot as of Apr. 26, 2013 (2 pages).

BEDDING APPARATUS

PRIORITY CLAIM

This application claims priority to and the benefit of U.S. Provisional Patent Application No. 61/829,733, filed on May 31, 2013, the entire contents of which are incorporated herein by reference.

BACKGROUND

Known bedding typically includes a fitted sheet that snugly fits over a mattress; a flat sheet positioned over the fitted sheet; and a blanket, comforter, or duvet positioned over the flat sheet. Since the flat sheet and the blanket are not securely attached to the mattress, the flat sheet and the blanket may (and commonly do) substantially shift and/or fall off of the mattress during use (such as when a user is sleeping). This can cause certain users discomfort, such as causing the users to become cold in the middle of the night and disrupting the user's sleep. Additionally, this makes it more difficult and time consuming for the user to make the bed, as the user must first gather and re-position the flat sheet and the blanket before making the bed.

There is, therefore, a continuing need for bedding apparatuses that do not shift or fall off of the mattress during use and that facilitate quickly and easily making the bed after use.

SUMMARY

Various embodiments of the present disclosure provide a bedding apparatus. In one embodiment, the bedding apparatus is configured to slip over a mattress such that the bedding apparatus substantially encloses the mattress except the front or head of the mattress. The bedding apparatus is configured such that, once installed over the mattress, there is sufficient space between the top of the mattress and a top panel of the bedding apparatus to enable a user to lay atop the mattress and under the top panel of the bedding apparatus. Additionally, once the bedding apparatus is installed, a bottom panel of the bedding apparatus is positioned under the mattress such that the bedding apparatus is held in place by a combination of the weight of the mattress and the weight of the user (when the user is laying on the mattress). Thus, when the mattress is in use, such as when the user is sleeping, the combination of the weight of the user and the weight of the mattress secures the bedding apparatus in place such that the bedding apparatus does not substantially shift. In this embodiment, the bedding apparatus includes attachment mechanisms (such as zippers) along either side panel that enable the user to quickly and easily make the bed after use.

DETAILED DESCRIPTION

Various embodiments of the present disclosure provide a bedding apparatus. In one embodiment, the bedding apparatus is configured to slip over a mattress such that the bedding apparatus substantially encloses the mattress except the front or head of the mattress. The bedding apparatus is configured such that, once installed over the mattress, there is sufficient space between the top of the mattress and the top panel of the bedding apparatus to enable a user to lay atop the mattress and under a top panel of the bedding apparatus. Additionally, once the bedding apparatus is installed, a bottom panel of the bedding apparatus is positioned under the mattress such that the bedding apparatus is held in place by a combination of the weight of the mattress and the weight of the user (when the user is laying on the mattress). Thus, when the mattress is in use, such as when the user is sleeping, the combination of the weight of the user and the weight of the mattress secures the bedding apparatus in place such that the bedding apparatus does not substantially shift. In this embodiment, the bedding apparatus includes attachment mechanisms (such as zippers) along either side panel that enable the user to quickly and easily make the bed after use.

Figure 1:
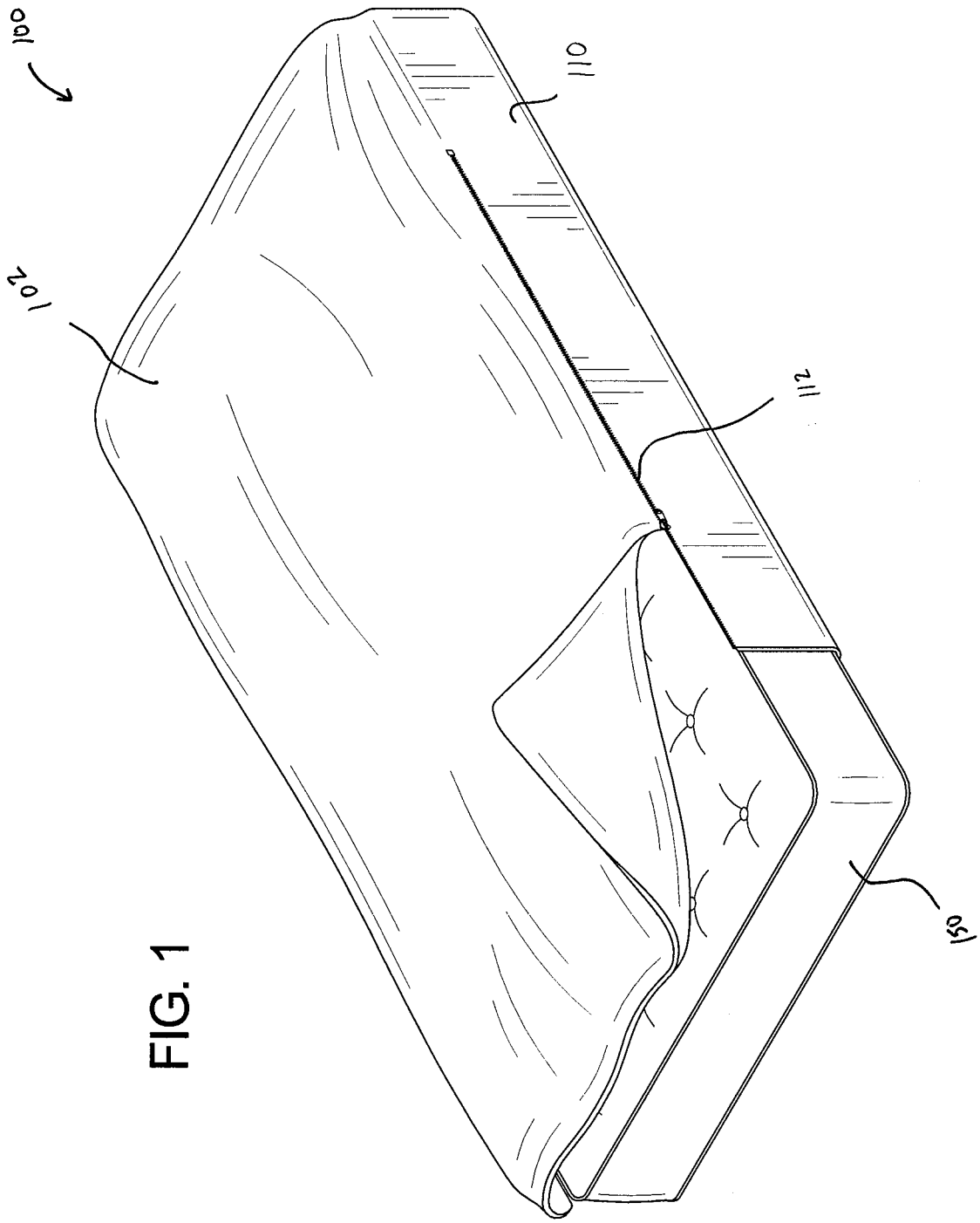
FIG. 1 is a front top perspective view of one example embodiment of the bedding apparatus of the present disclosure in a resting state and installed around a mattress.

Turning to the Figures, FIG. 1 shows one embodiment of the bedding apparatus, which is generally indicated by numeral 100, in a resting state. FIGS. 2 to 11 show the bedding apparatus 100 in an expanded state for illustrative purposes. In this embodiment, the bedding apparatus 100 includes: (a) a generally rectangular top panel 102 having a length L1 and a width W1; (b) a spaced apart opposing generally rectangular bottom panel 114 having a length L2 (which is less than the length L1) and the width W1; (c) a left side panel 106 including a generally rectangular upper portion having the length L1 and a height H1 and a generally rectangular lower portion having the length L2 and the height H1, the upper and lower portions being partially separated and partially joined or connected; (d) a spaced apart opposing right side panel 110 including a generally rectangular upper portion having the length L1 and the height H1 and a generally rectangular lower portion having the length L2 and the height the upper and lower portions being partially separated and partially joined or connected; (e) a generally rectangular back panel 108 having a height H2 (which is approximately twice the height H1) and the width W1; (f) a left attachment mechanism 104, which is a zipper in this embodiment, configured to join (and unjoin) the partially separated upper and lower portions of the left side panel 106; and (g) a right attachment mechanism 112, which is a zipper in this embodiment, configured to join (and unjoin) the partially separated upper and lower portions of the right side panel 110.

In this embodiment: (a) a right edge of the top panel 102 is joined or connected to a top edge of the upper portion of the right side panel 110, (b) a back edge of the top panel 102 is joined or connected to a top edge of the back panel 108, (c) a left edge of the top panel 102 is joined or connected to a top edge of the upper portion of the left side panel 106, (d) a right edge of the bottom panel 114 is joined or connected to a bottom edge of the lower portion of the right side panel 110, (e) a back edge of the bottom panel 114 is joined or connected to a bottom edge of the back panel 108, (f) a left edge of the bottom panel 114 is joined or connected to a bottom edge of the lower portion of the left side panel 106, (g) a right edge of the back panel 108 is joined or connected to a back edge of the right side panel 110, and (h) a left edge of the back panel 108 is joined or connected to a back edge of the left side panel 106. In this embodiment, inner surfaces of the top panel 102, the back panel 108, the left side panel 106, the right side panel 110, and the bottom panel 114 define a mattress receiving space.

In operation of this embodiment, the bedding apparatus 100 is installed around a mattress 150, such as a traditional mattress, an air mattress, or any other suitable type of mattress. More specifically, to install the bedding apparatus 100 around the mattress 150, a user slides the mattress 150 into the mattress receiving space of the bedding apparatus 100 such that: (i) a bottom face of the mattress lays atop the inner surface of the bottom panel 114 of the bedding apparatus 100, (ii) a back face of the mattress is positioned proximate the inner surface of the back panel 108 of the bedding apparatus 100, (iii) a right face of the mattress is positioned proximate the inner surface of the right side panel 110 of the bedding apparatus 100, and (iv) a left face of the mattress is positioned proximate the inner surface of the left side panel 106 of the bedding apparatus 100. Put differently, the user slides the bottom panel 114 of the bedding apparatus 100 under the mattress 150 such that the bedding apparatus 100 substantially encloses the mattress 150 except for the front or head of the mattress 150. It should be appreciated that one or more of the right and left zippers 104 and 112 may be unzipped to facilitate sliding the bottom panel 114 of the bedding apparatus under the mattress 150.

Figure 2:
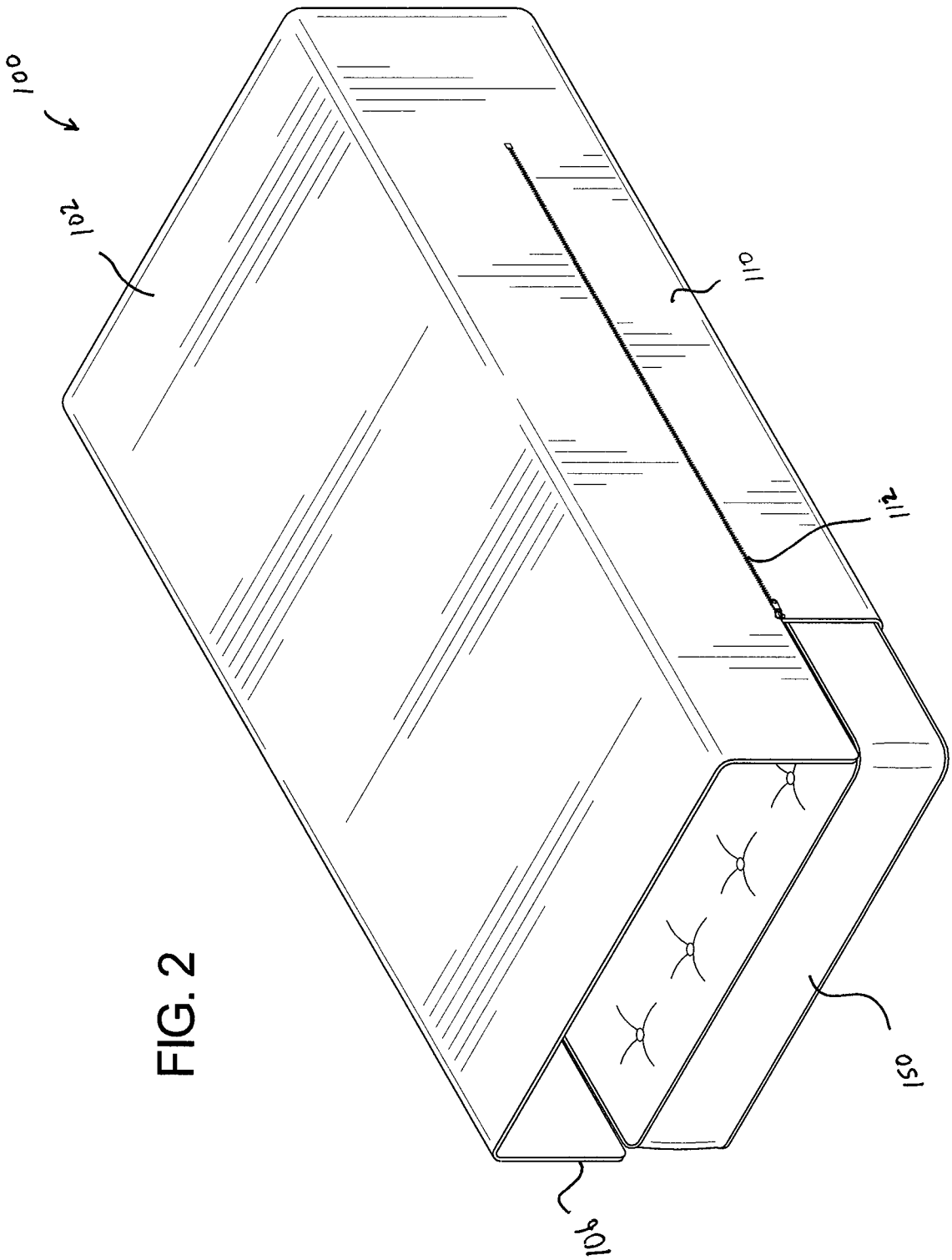
FIG. 2 is a front top perspective view of the bedding apparatus of FIG. 1 in an expanded state and installed around a mattress.
Figure 3:
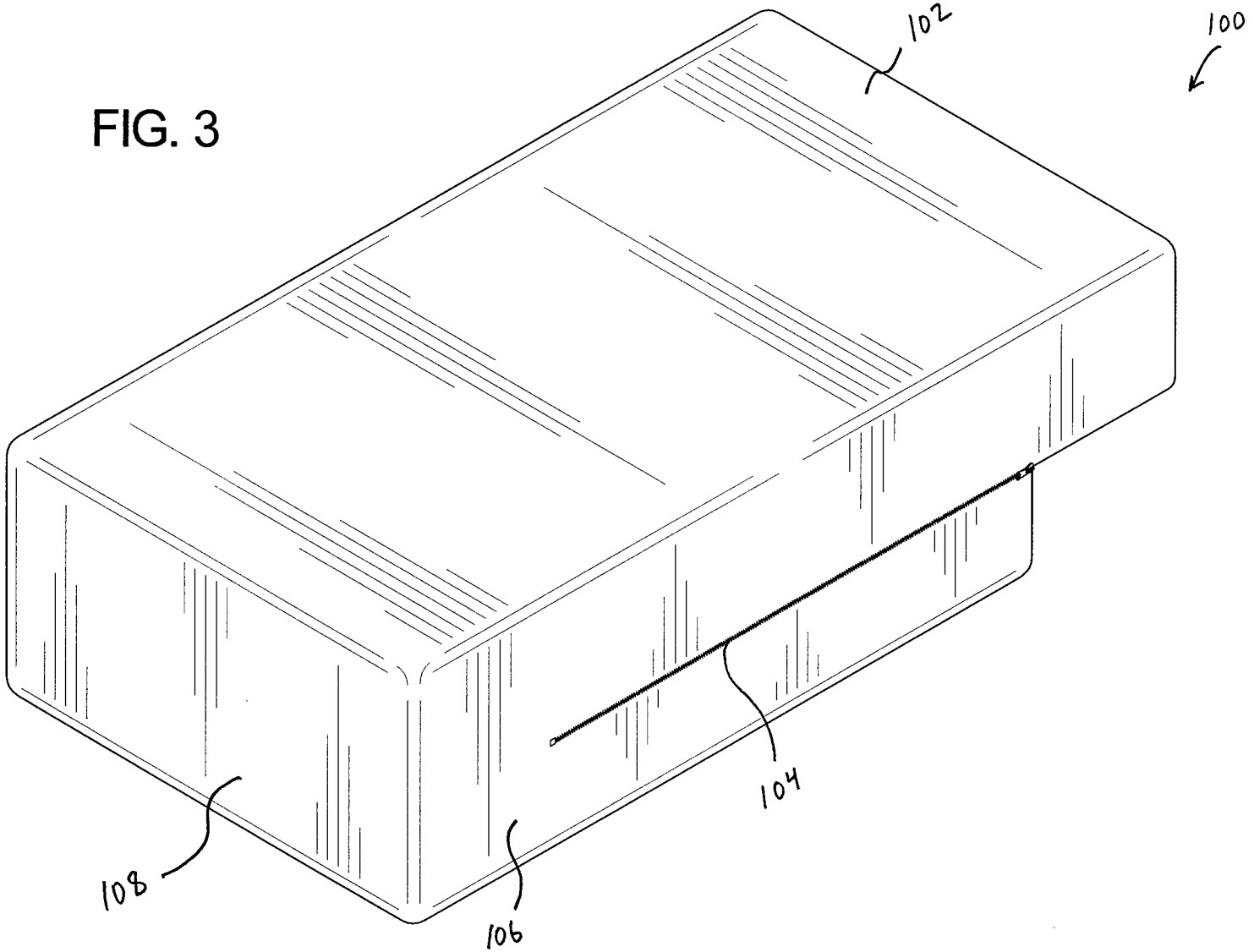
FIG. 3 is a rear top perspective view of the bedding apparatus of FIG. 1 in the expanded state.
Figure 4:
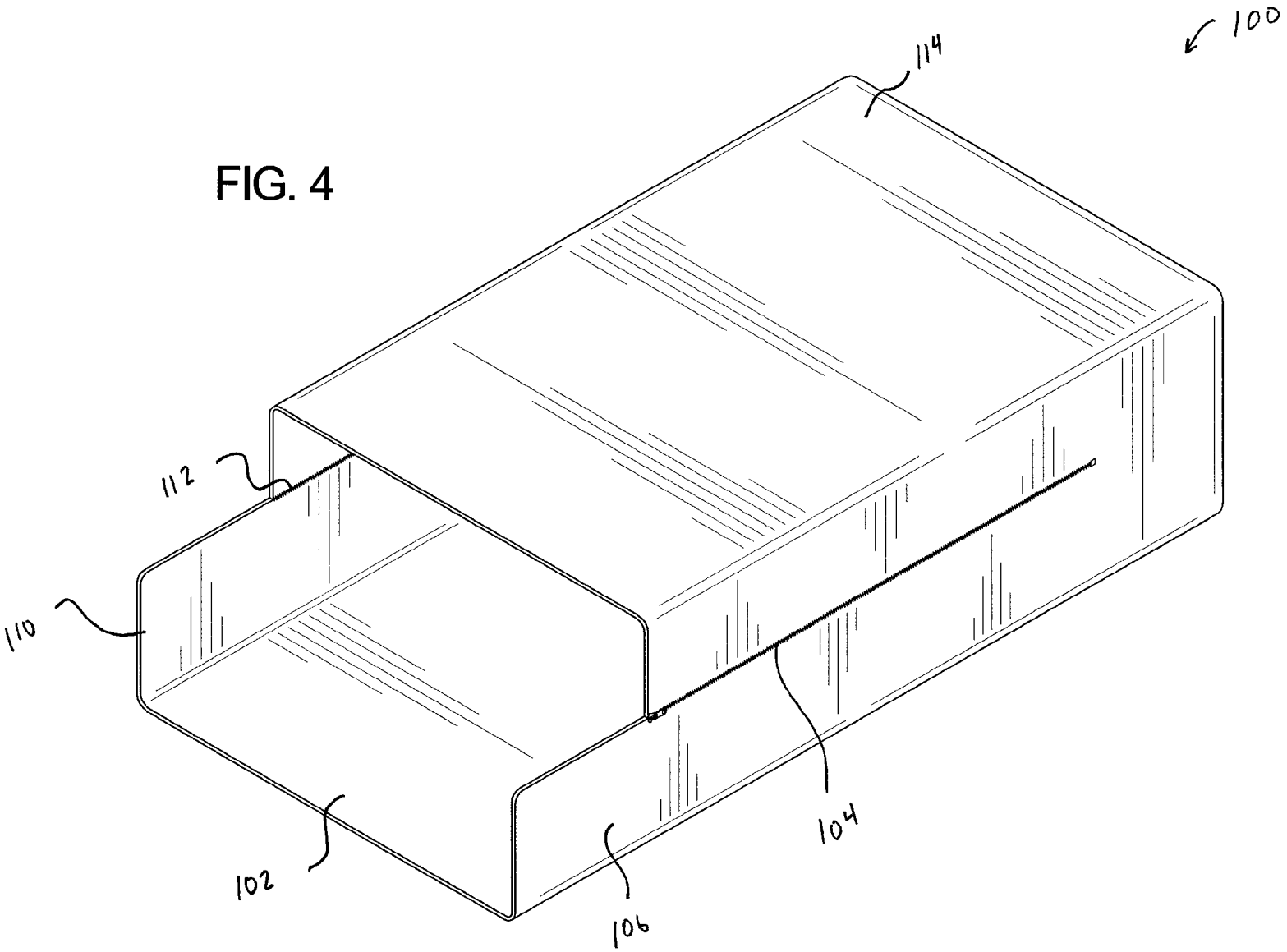
FIG. 4 is a front bottom perspective view of the bedding apparatus of FIG. 1 in the expanded state.
Figure 5:
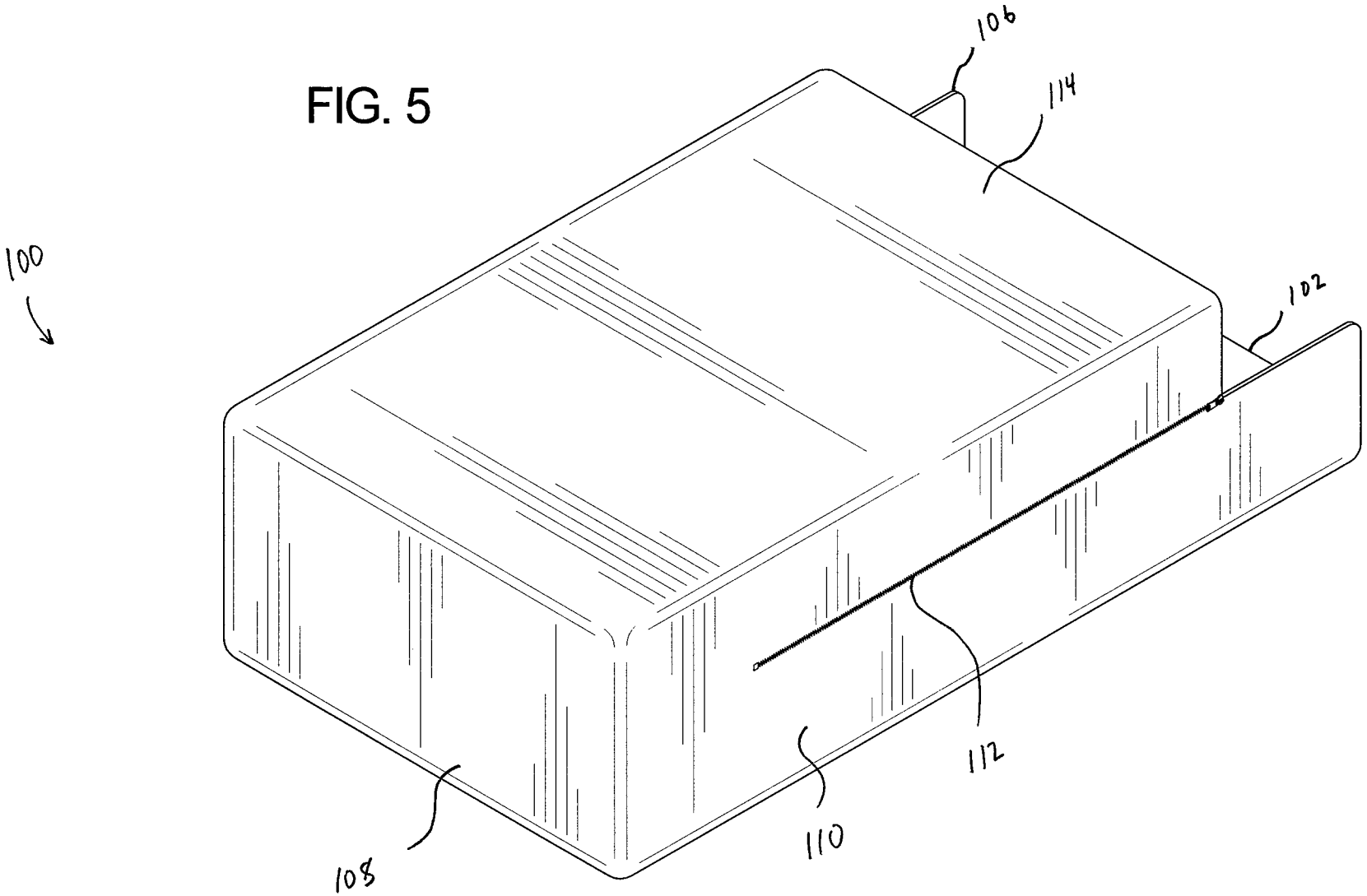
FIG. 5 is a rear bottom perspective view of the bedding apparatus of FIG. 1 in the expanded state.
Figure 6:
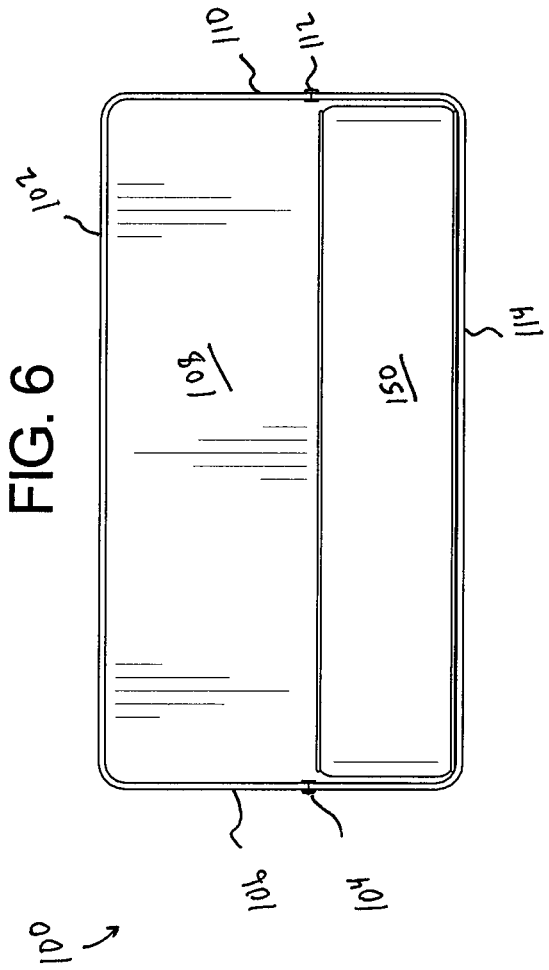
FIG. 6 is a front elevational view of the bedding apparatus of FIG. 1 in the expanded state and installed around a mattress.
Figure 7:
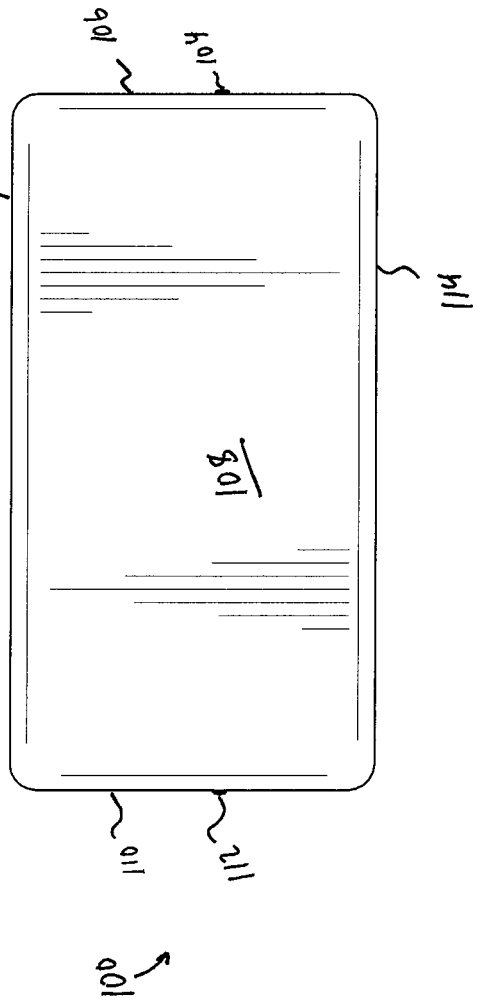
FIG. 7 is a rear elevational view of the bedding apparatus of FIG. 1 in the expanded state.
Figure 8:
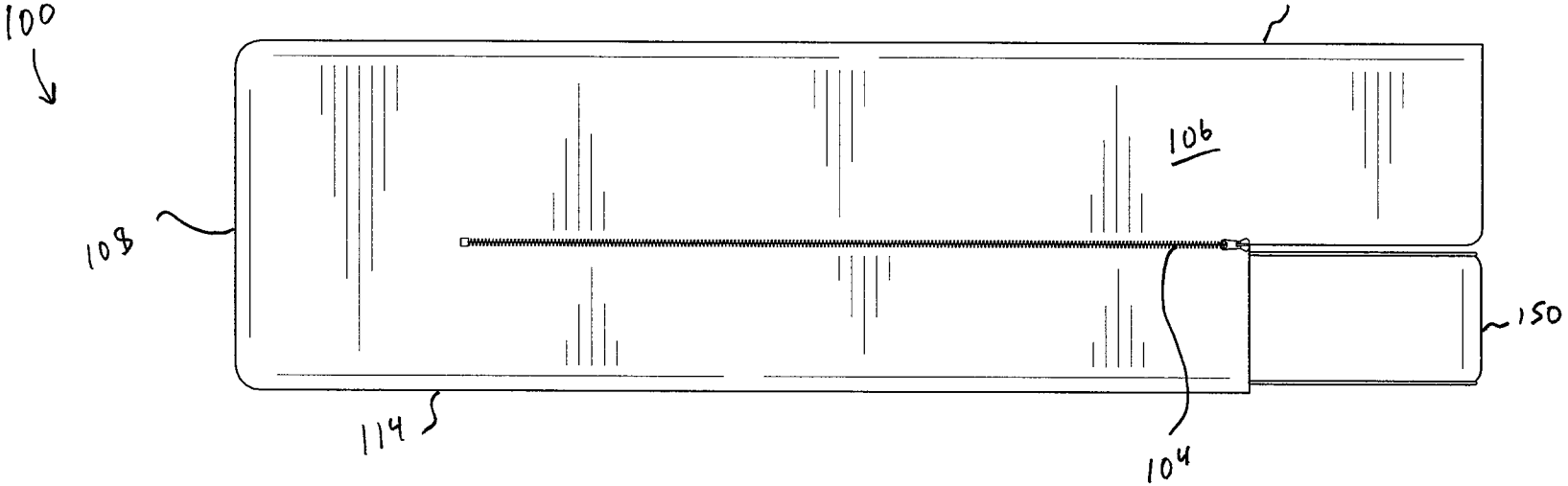
FIG. 8 is a left side elevational view of the bedding apparatus of FIG. 1 in the expanded state and installed around a mattress.
Figure 9:
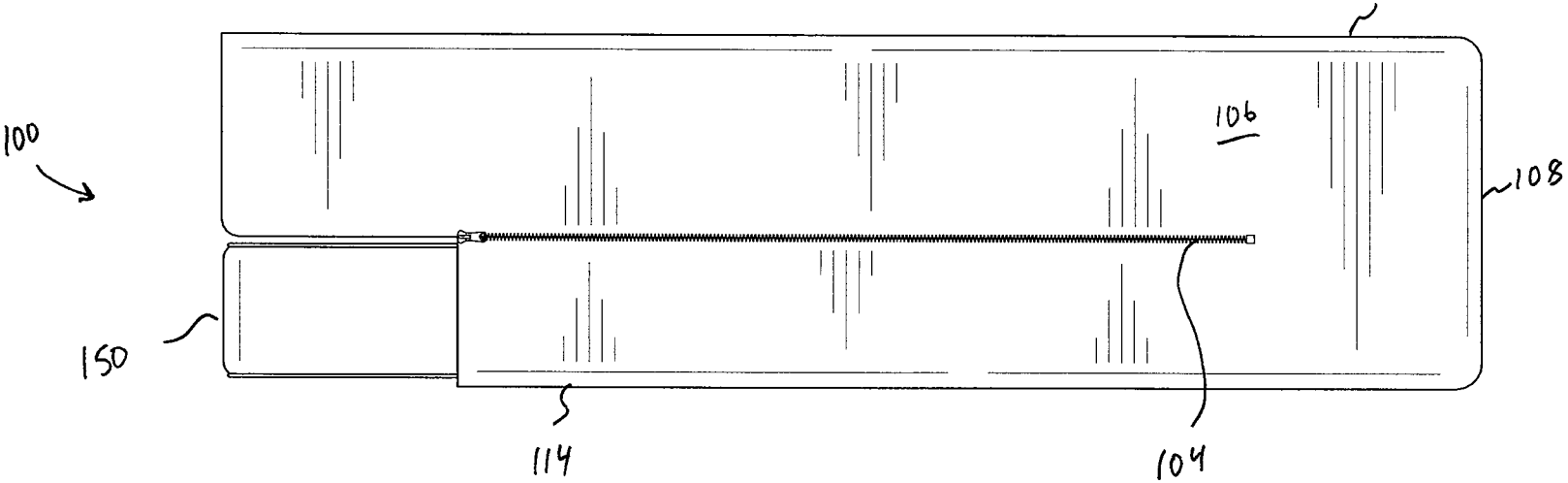
FIG. 9 is a right side elevational view of the bedding apparatus of FIG. 1 in the expanded state and installed around a mattress.
Figure 10:
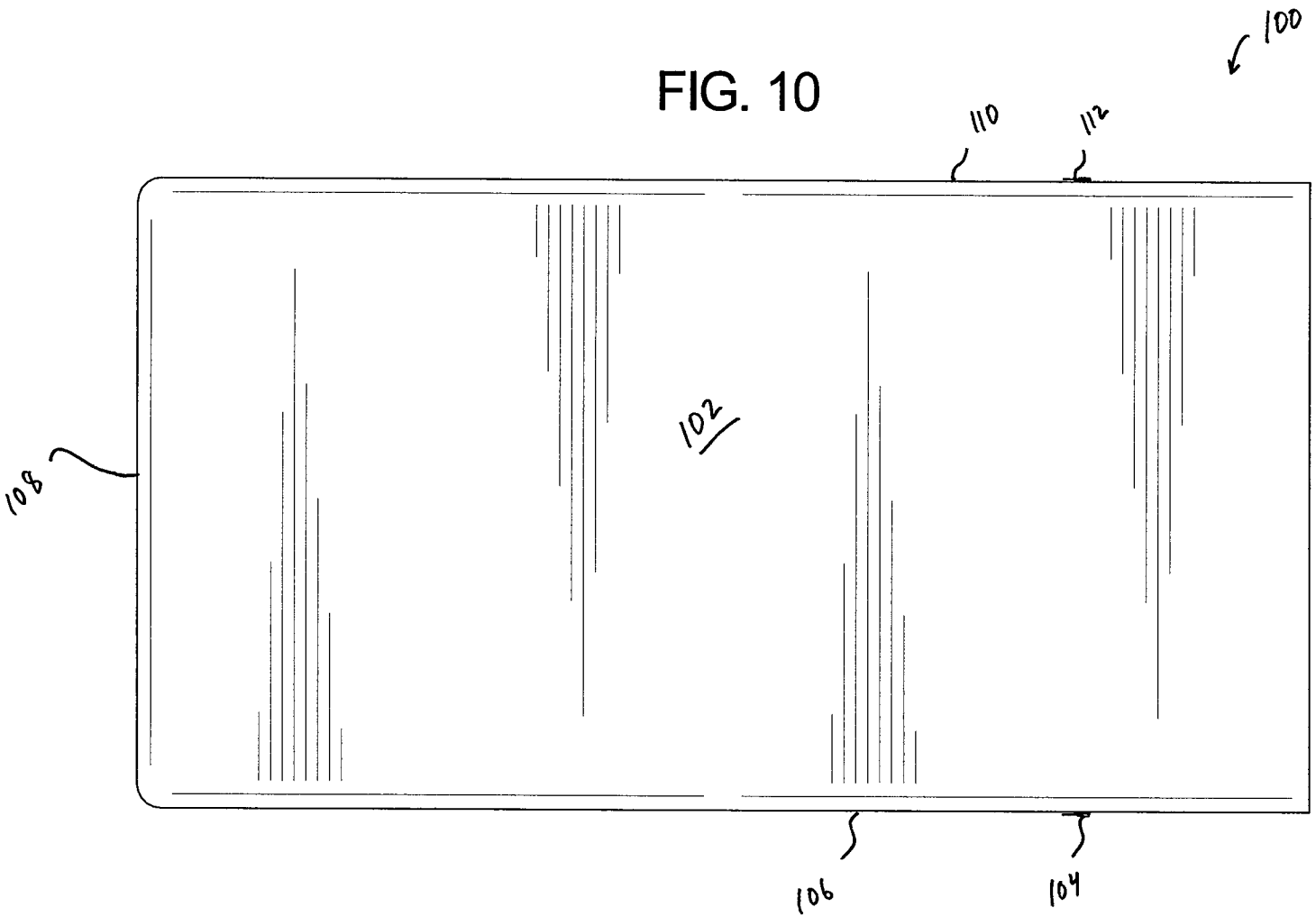
FIG. 10 is a top plan view of the bedding apparatus of FIG. 1 in the expanded state.
Figure 11:
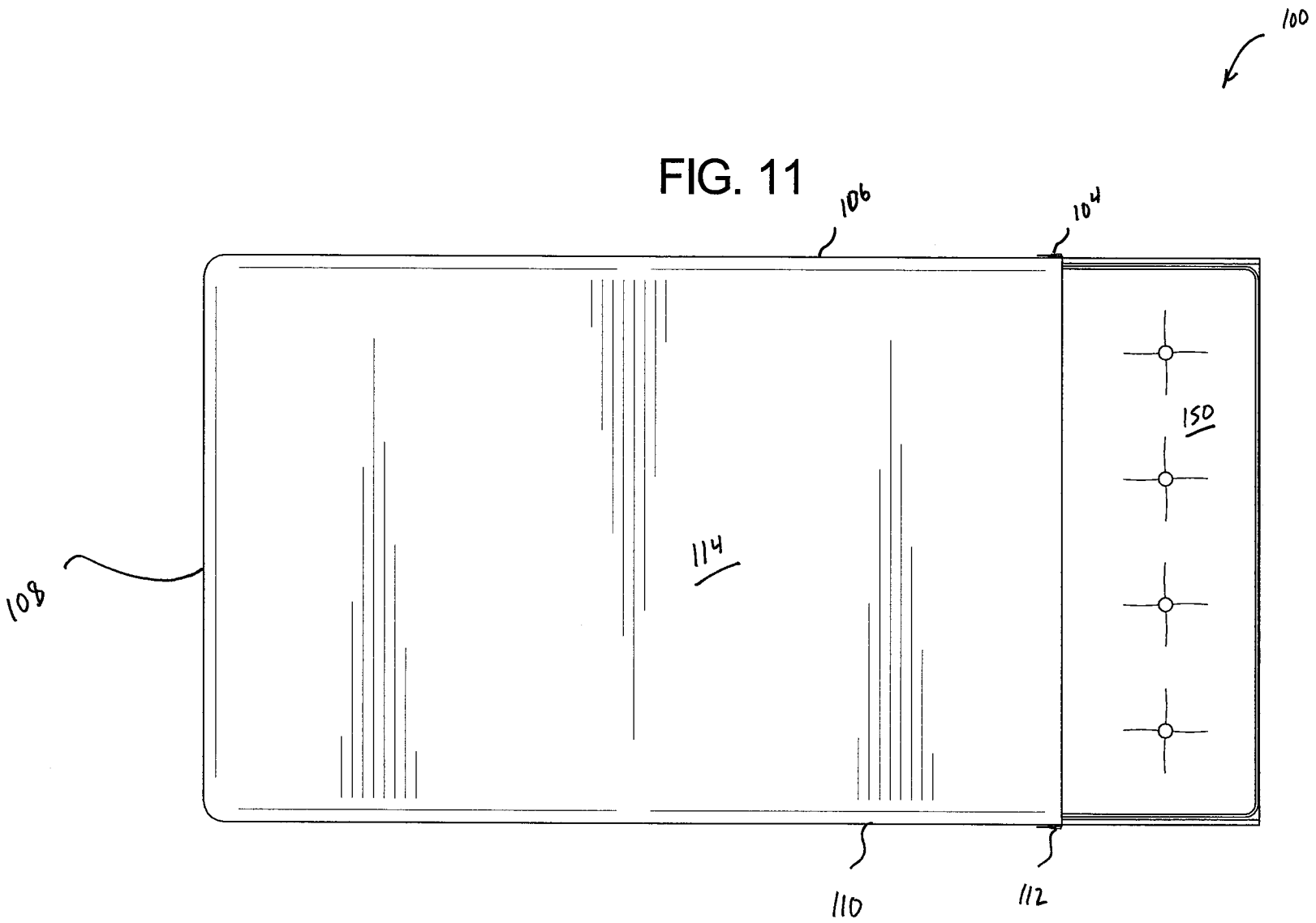
FIG. 11 is a bottom plan view of the bedding apparatus of FIG. 1 in the expanded state and installed around a mattress.

As best shown in FIG. 2, after installation, the mattress occupies substantially the lower half of the mattress receiving space, leaving the upper half of the mattress receiving space vacant. This vacant space enables the user to lay atop the mattress and under the top panel of the bedding apparatus. In this embodiment, the bedding apparatus is held in place by a combination of the weight of the mattress and the weight of a user when the user is laying on the mattress. Thus, when the mattress is in use, such as when the user is sleeping, the combination of the weight of the user and the weight of the mattress secures the bedding apparatus in place such that the bedding apparatus does not substantially shift.

The user may unzip one or more of the zippers to facilitate getting under the top panel of the bedding apparatus and/or getting out from under the top panel of the bedding apparatus. The user may also unzip one or more of the zippers to facilitate changing bed sheets, such as a fitted sheet. The user may also zip up the zippers after use to quickly and easily make the bed.

It should be appreciated that the bottom panel of the bedding apparatus may be held in place between the mattress and a box spring, the mattress and a bunkie board, the mattress and a floor, or the mattress and any other suitable structure or object.

It should be appreciated that the bedding apparatus of the present disclosure may be sized to fit one of a variety of different mattress sizes, such as, but not limited to: (a) a twin size mattress, (b) an extra-long twin size mattress, (e) a full size mattress, (d) an extra-long full size mattress, (e) a queen size mattress, (I) a California king size mattress, and (g) a king size mattress.

In another embodiment, the bedding apparatus includes a single attachment mechanism rather than two attachment mechanisms. In one example of this embodiment, one of the left and the right side panels does not include an attachment mechanism, and the entire upper and lower portions of that side panel are joined or connected. In another example of this embodiment, the bedding apparatus includes a single attachment mechanism that extends along both side panels and the back panel of the bedding apparatus. In another embodiment, the bedding apparatus includes a third attachment mechanism. In one example of this embodiment, the back panel of the bedding apparatus includes partially (or completely) separated upper and lower portions, and the third attachment mechanism is configured to join (and unjoin) the partially separated upper and lower portions of the back panel of the bedding apparatus.

It should be appreciated that the attachment mechanism may be any suitable attachment mechanism instead of or in addition to a zipper such as, but not limited to, a hook and loop fastener (such as a Velcro® fastener), a plurality of buttons, a plurality of snaps, a tied elastic string or band, clips, or any other suitable reclosable fastener.

In another embodiment, the lengths of the top panel, the bottom panel, the upper and lower portions of the left side panel, and the upper and lower portions of the right side panel of the bedding apparatus are the same, though it should be appreciated that the different components of the bedding apparatus may have any suitable size.

The bedding apparatus may be made of any suitable material such as, but not limited to: natural fabric such as cotton, wool, silk, cashmere, or linen; synthetic fabric such as rayon, polyester (fleece or cotton blend), nylon, or acrylic; lightweight fabric such as linen, nylon, or cotton; and/or heavy weight fabric such as polar fleece, cozy fleece, or wool. The material of the bedding apparatus may include a single layer or multiple layers. In one example embodiment, the bedding apparatus is made of a multi-layer fabric including an outer layer of anti-pill fleece and an inner layer of fleece.

In one embodiment, the bedding apparatus is formed from a single piece of material. In another embodiment, the bedding apparatus is formed from a plurality of pieces or material (such as a plurality of pieces of material joined or connected (such as sewed) together to form the bedding apparatus).

In one embodiment, the top panel of the bedding apparatus is made of an expandable or stretchable material. This provides the user with extra room to maneuver when laying atop the mattress beneath the top panel of the bedding apparatus. In another embodiment, the side panels of the bedding apparatus are made of the expandable or stretchable material. In another embodiment, the back panel of the bedding apparatus is made of the expandable or stretchable material. It should appreciated that any suitable combination of the top panel, the back panel, and the side panels are made of the expandable or stretchable material.

In other embodiments, the height of the upper portions of the side panels is larger than the height of the lower portions of the side panels. There embodiments provide additional room for the user to maneuver when laying atop the mattress and under the top panel of the bedding apparatus. It should be appreciated that the various components of the bedding apparatus may be sized in any suitable manner.

In one embodiment, two bedding apparatuses are configured to be joined or connected to one another, such as via the attachment mechanisms, to form a larger, combined double bedding apparatus. For example, the right attachment mechanism of one bedding apparatus is connected to the left attachment mechanism of another bedding apparatus.

In other embodiments, the bedding apparatus includes one or more interior or exterior pockets. In another embodiment, the bedding apparatus includes one or more integrated interior or exterior cable channels configured to route cables, such as cell phone charger or tablet computer charger cables, from one end (such as the rear end) of the bedding apparatus to another (such as the front end).

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A bedding apparatus comprising:

(a) a generally rectangular top panel having a first length and a first width;

(b) an opposing generally rectangular bottom panel having a second length and the first width, the first length being greater than the second length;

(c) a left side panel spanning the top panel and the bottom panel, the left side panel including a generally rectangular upper portion having the first length and a first height and a partially separated generally rectangular lower portion having the second length and a second height;

(d) an opposing right side panel spanning the top panel and the bottom panel, the right side panel including a generally rectangular upper portion having the first length and the first height and a partially separated generally rectangular lower portion having the second length and the second height;

(e) a generally rectangular back panel spanning the top panel and the bottom panel, the back panel having the first width; and (f) an attachment mechanism configured to join the partially separated upper and lower portions of one of the side panels.

2. The bedding apparatus of claim 1, wherein the attachment mechanism is a zipper.

3. The bedding apparatus of claim 1, wherein an inner surface of the top panel, an inner surface of the back panel, an inner surface of the left side panel, an inner surface of the right side panel, and an inner surface of the bottom panel define a mattress receiving space configured to receive a mattress.

4. The bedding apparatus of claim 3, wherein at least one-half of the mattress receiving space is not occupied by the mattress after the bedding apparatus receives the mattress.

5. The bedding apparatus of claim 1, which includes a first attachment mechanism configured to join the partially separated upper and lower portions of the left side panel and a second different attachment mechanism configured to join the partially separated upper and lower portions of the right side panel.

6. The bedding apparatus of claim 1, wherein the first height and the second height are the same.

7. The bedding apparatus of claim 1, wherein the first height and the second height are different.

8. The bedding apparatus of claim 1, wherein the back panel has a height equal to a sum of the first and second heights.

9. A bedding apparatus comprising:

(a) a generally rectangular top panel having a first length and a first width;

(b) an opposing generally rectangular bottom panel having a second length and the first width, the first length being greater than the second length;

(c) a left side panel spanning the top panel and the bottom panel, the left side panel including a generally rectangular upper portion having the first length and a first height and a partially separated generally rectangular lower portion having the second length and a second height;

(d) an opposing right side panel spanning the top panel and the bottom panel, the right side panel including a generally rectangular upper portion having the first length and the first height and a partially separated generally rectangular lower portion having the second length and the second height;

(e) a generally rectangular back panel spanning the top panel and the bottom panel, the back panel having the first width;

(f) a first zipper configured to join the partially separated upper and lower portions of the left side panel; and (g) a second different zipper configured to join the partially separated upper and lower portions of the right side panel.

10. The bedding apparatus of claim 9, wherein an inner surface of the top panel, an inner surface of the back panel, an inner surface of the left side panel, an inner surface of the right side panel, and an inner surface of the bottom panel define a mattress receiving space configured to receive a mattress.

11. The bedding apparatus of claim 10, wherein at least one-half of the mattress receiving space is not occupied by the mattress after the bedding apparatus receives the mattress.

12. The bedding apparatus of claim 9, wherein the first height and the second height are the same.

13. The bedding apparatus of claim 9, wherein the first height and the second height are different.

14. The bedding apparatus of claim 9, wherein the back panel has a height equal to a sum of the first and second heights.

15. A bedding apparatus comprising:

(a) a generally rectangular top panel having a first length and a first width;

(b) an opposing generally rectangular bottom panel having a second length and the first width, the first length being greater than the second length;

(c) a left side panel spanning the top panel and the bottom panel, the left side panel including a generally rectangular upper portion having the first length and a first height and a partially separated generally rectangular lower portion having the second length and a second height;

(d) an opposing right side panel spanning the top panel and the bottom panel, the right side panel including a generally rectangular upper portion having the first length and the first height and a partially separated generally rectangular lower portion having the second length and the second height;

(e) a generally rectangular back panel spanning the top panel and the bottom panel, the back panel having the first width;

(f) a first zipper configured to join the partially separated upper and lower portions of the left side panel; and (g) a second different zipper configured to join the partially separated upper and lower portions of the right side panel, wherein an inner surface of the top panel, an inner surface of the back panel, an inner surface of the left side panel, an inner surface of the right side panel, and an inner surface of the bottom panel define a mattress receiving space configured to receive a mattress such that at least one-half of the mattress receiving space is not occupied by the mattress after the bedding apparatus receives the mattress.

16. The bedding apparatus of claim 15, wherein the first height and the second height are the same.

17. The bedding apparatus of claim 15, wherein the first height and the second height are different.

18. The bedding apparatus of claim 15, wherein the back panel has a height equal to a sum of the first and second heights.

* * * * *